US006016916A

United States Patent [19]

Ortner

[11] Patent Number: 6,016,916

[45] Date of Patent: Jan. 25, 2000

[54] PACKAGING UNIT FOR ROD-SHAPED PERFUME BOTTLES

[76] Inventor: Georg Ortner, Lubecker Strasse 13, D-50668 Cologne, Germany

[21] Appl. No.: 09/078,256

[22] Filed: May 13, 1998

[51] Int. Cl.[7] ..... B65D 69/00

[52] U.S. Cl. ..... 206/581; 206/806; 206/823; 222/321.9; 222/325; 132/294

[58] Field of Search ..... 132/286, 294, 132/314; 206/38, 229, 581, 823, 806; 222/321.7, 321.9, 325, 44.5

[56] References Cited

U.S. PATENT DOCUMENTS

| | | | |
|---|---|---|---|
| 105,269 | 7/1870 | Spencer | 132/314 |
| 2,497,950 | 2/1950 | Lohr et al. | 206/229 |
| 2,639,806 | 5/1953 | Recht | 206/581 |
| 3,236,418 | 2/1966 | Dalle et al. | 222/144.5 |
| 4,250,993 | 2/1981 | Roccaforte et al. . | |
| 4,391,457 | 7/1983 | Gassner | 206/214 |
| 5,092,457 | 3/1992 | Islava et al. . | |
| 5,330,056 | 7/1994 | De La Rocha | 206/581 |
| 5,358,101 | 10/1994 | Lombardi | 206/581 |
| 5,407,076 | 4/1995 | Sabet | 206/581 |
| 5,507,401 | 4/1996 | Huang | 215/12.1 |
| 5,590,835 | 1/1997 | Rosenthal et al. | 239/333 |
| 5,791,481 | 8/1998 | Thomas | 206/581 |
| 5,833,121 | 11/1998 | Gueret | 222/144.5 |

FOREIGN PATENT DOCUMENTS

| | | |
|---|---|---|
| 896623 | 7/1949 | Germany . |
| 320626 | 3/1957 | Switzerland . |

*Primary Examiner*—Paul T. Sewell
*Assistant Examiner*—J. Mohandesi
*Attorney, Agent, or Firm*—Helfgott & Karas, P.C.

[57] ABSTRACT

A packaging unit for rod-shaped perfume bottles, each comprising a cylindrical perfume container (9), a metering pump that can be mounted thereon to close the container, and a cap (11), with or without a clip part, that can be slipped onto the metering pump comprises an elongated case (1) comprising container part (2) and lid (3), the container part (2) having at least two compartments. In one compartment there is placed a bottle in completely assembled form or in the form of individual parts with or without perfume container (9), and in the other compartment there is provided a number N of identical perfume containers (9), which are closed with a closure element (8) instead of a metering pump. The packaging unit contains 25 ml of perfume fluid or a multiple thereof.

14 Claims, 7 Drawing Sheets

PACKAGING UNIT FOR ROD-SHAPED PERFUME BOTTLES

Figure 1:
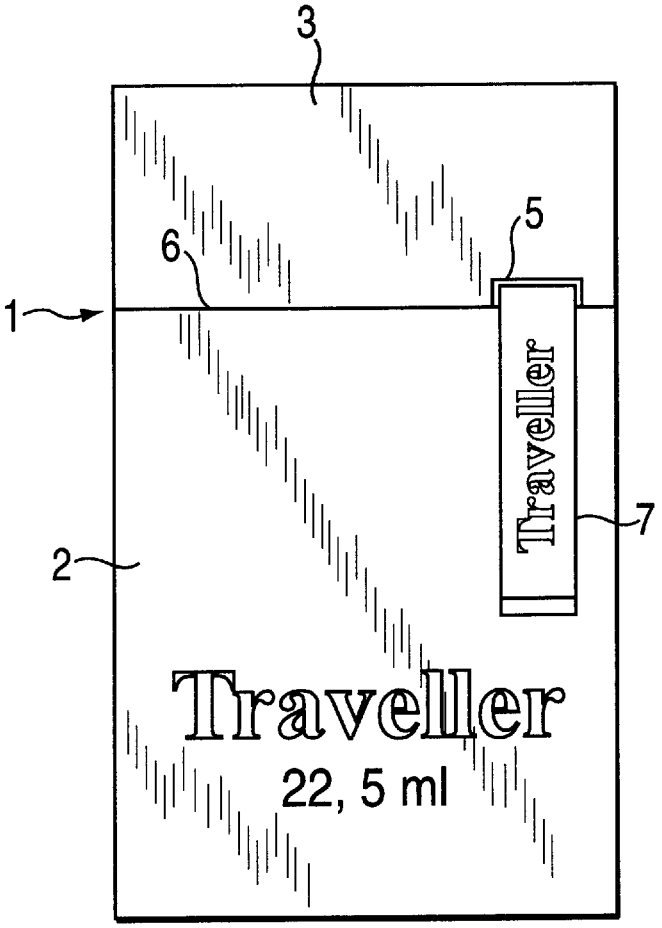

The present invention relates to a packaging unit for rod-shaped perfume bottles.

Perfumes are usually offered on the market in bottles of 4 ml capacity and larger with screw-on closure. Bottles with a closure cap, under which there is located a metering pump to dispense the perfume, are also widely available. Standard sales volumes are bottles with 25, 50, 75 and 100 ml capacity. In practice, this means that, for each volume increment, a perfume container designed exclusively therefor is necessary; occasionally the same metering pumps and closure caps are used for bottles of different sizes.

Because of the different bottle sizes, different bottling systems or systems with exactly adjustable bottling volume are also necessary.

A bottle known by the name "Duftpen" has the form of a pen resembling a fountain pen comprising body and slip-on cap, wherein the body is replaced by a tubular glass-like perfume container, which is sealed at one end with a metering pump, whose diameter corresponds approximately to that of the glass tube. Over the metering pump and onto the container there is slipped a cap, which completely covers the metering pump and which, in the manner of a fountain-pen cap, is provided with a clip for clipping the scent pen equipped with a cap over a holding flap, such as the hem of a shirt or coat pocket, or in other words preferably where a fountain pen is also clipped. The known "scent pens" comprise containers made of glass tubes having a filling capacity of between 7.5 and 10.0 ml of fluid volume. Preferred filling volumes are 7.5, 8.25 or 10 ml of perfume. Such a "scent pen" is used in a way as a short-term perfume supply, which the user always has available in a pocket or on her clothing. It is refillable, since the metering pumps used are provided with a screw-on sleeve, with which they can be screwed sealingly onto a threaded end of the glass container.

The object of the present invention is to avoid the disadvantage of different bottle sizes and thus of different bottling systems for the standard sales volumes.

Certainly packaging units with a plurality of administration units are known from the art of pharmaceuticals packages, but these contain either injection or ingestion sizes for one-time consumption, wherein no injection or dispensing device is provided in the same package, or they relate to refill vials for a dispensing device, which vials necessitate decanting and preparation operations, neither of which falls within the scope of the present invention.

The basic object of the invention is achieved by a packaging unit having the features of claim 1.

The packaging unit according to the invention retains substantially the volume increments of standard bottle containers, but manages with container sizes, having empty volumes of 7.5 to 10 ml respectively, for example the known "scent pen". To reduce the "scent-pen" system to practice, it is the intention according to the invention to develop packaging units which each comprise a plurality of such "scent pens", or in other words a three-pack amounting to 25 ml, a five- or six-pack amounting to 50 ml, a ten-pack amounting to 75 ml and, for example, a twelve-pack amounting to 100 ml of total volume per packaging unit.

Advantageously, what will be supplied in each packaging unit is not all parts of a "scent pen" in their respective number, but instead one completely assembled "scent pen" together with the remaining filling volume in the form of a plurality of perfume containers, each of which is sealed by a removable closure element instead of a metering pump.

For such a packaging unit, it is therefore sufficient if it contains a number N of perfume containers corresponding to the total filling volume and in addition a cap provided with a clip part and a metering pump. This also contributes advantageously to waste prevention. Furthermore, cumbersome decanting from a large bottle into the convenient scent pen is unnecessary, and any associated spilling of the expensive perfume is therefore avoided.

An advantageous embodiment of a packaging unit contains at least two compartments, one for the perfume container and another for a cap and a metering pump. Since the clip part mounted on the cap is usually adorned with a company logo, it is particularly advantageous to provide, in a box-like package sheath in which the said parts are placed, a cut-out through which the clip part protrudes outwardly, so that even when the package is closed it is visible on the outside thereof.

Paper, cardboard, plastic, metal or the likes is suitable as the packaging unit, and the lid is preferably foldingly hinged. In the interior, the case is divided into two compartments of different size by a partition running in the longitudinal direction of the case. The perfume containers are placed in a large compartment and a metering pump with a suction tube approximately as long as a perfume container is placed together with a cap in a small compartment. The case is conveniently divided transverse to its longitudinal direction, the top part being formed by the lid and the bottom part containing, inserted in longitudinal direction, the perfume container in the large compartment and also the said supplementary components such as metering pump and cap.

The perfume containers can be placed together in a separate box-like sheath, preferably with folding cover, which is inserted into the large compartment provided therefor in the case.

By virtue of the idea according to the invention, bottling and metering of the perfume volume is reduced to filling of a single bottle size, for example in the form of tubular "scent-pen" perfume containers, which are dimensioned in a standard size of between 7.5 and 10.0 ml. The perfume volume of a packaging unit is made up of an optional number N of such identical perfume bottles, and so preferably the standard volume increments can be achieved, namely the respective multiples of 25 ml as explained hereinabove. In this way it is possible to manage with a uniform bottle of the "scent-pen" or similar type. Such consistent standardization as regards container size and bottling technique permits a high degree of streamlining at both the manufacturing and sales levels for perfume or similar fluids offered on the market, if they are designed to be dispensed by means of a special device such as a metering pump, a ball-type closure or the like. In addition to perfume, other fluids for the body and beauty care can be considered preferably for the packaging system according to the invention. Furthermore, only one dispensing device and one cap are needed for a plurality of perfume containers.

Figure 2:
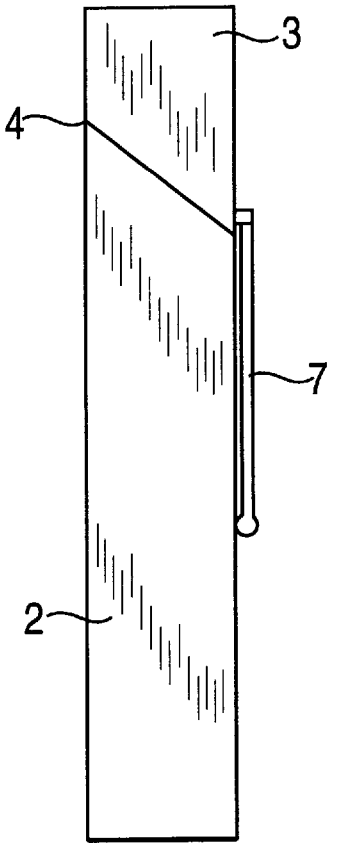
Figure 3:
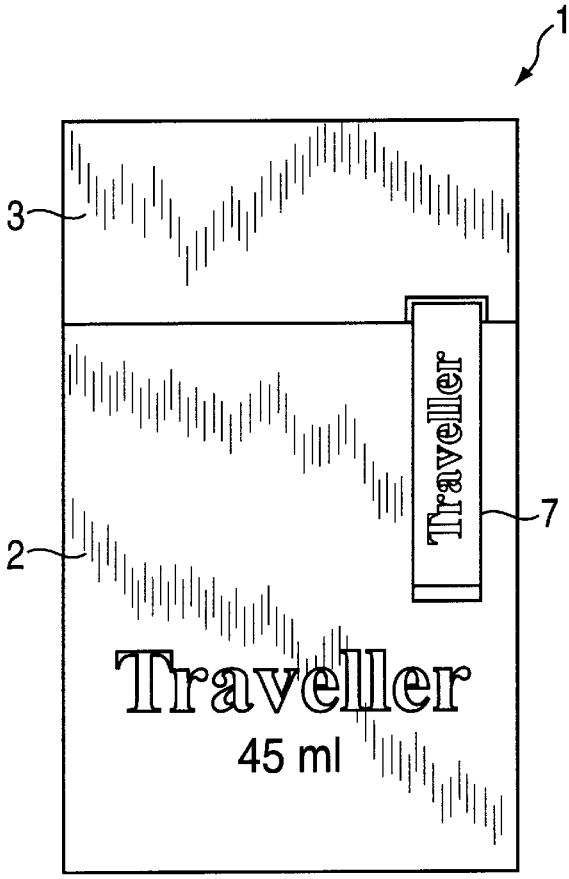
Figure 4:
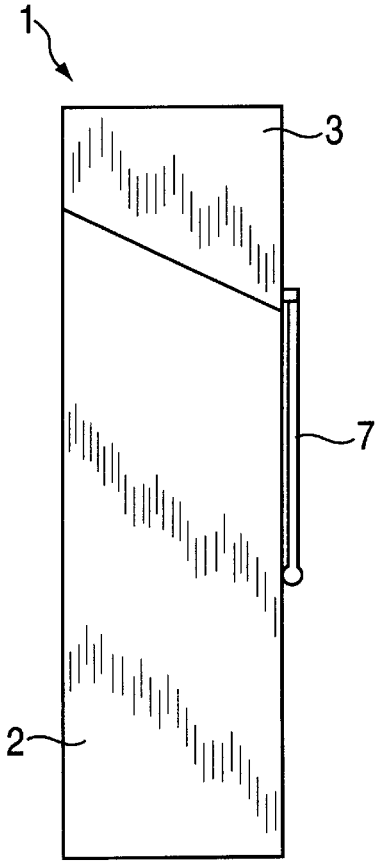
Figure 5:
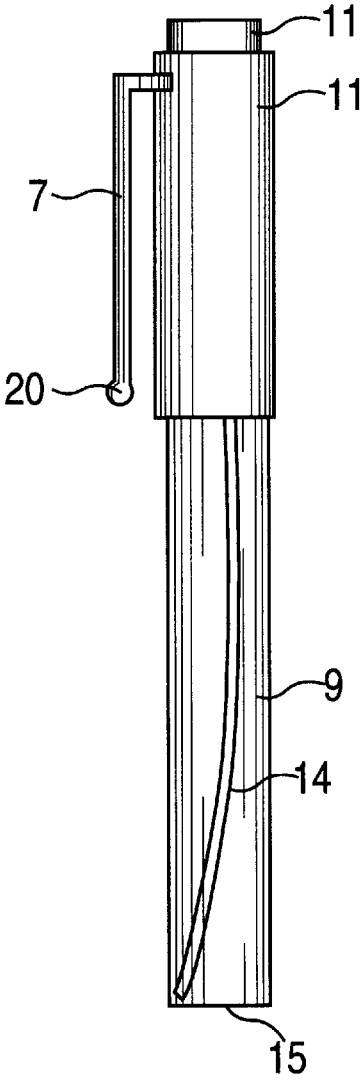
Figure 6:
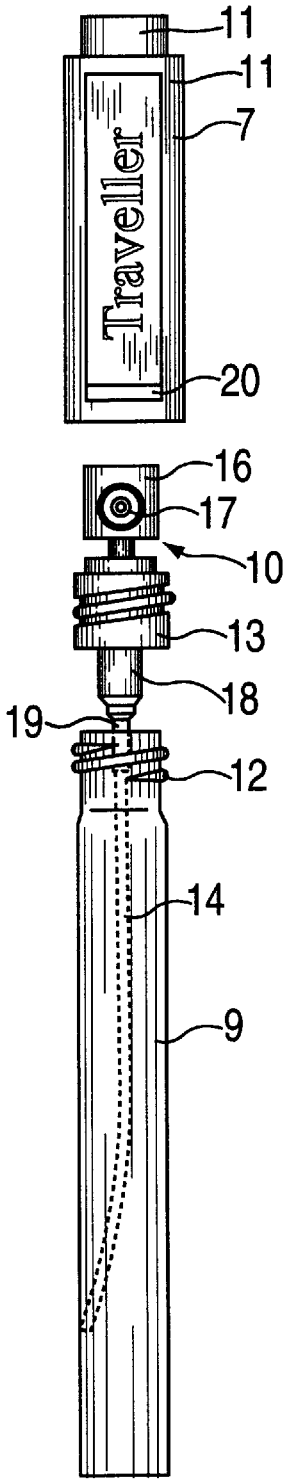
Figure 7:
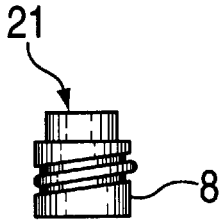
Figure 8:
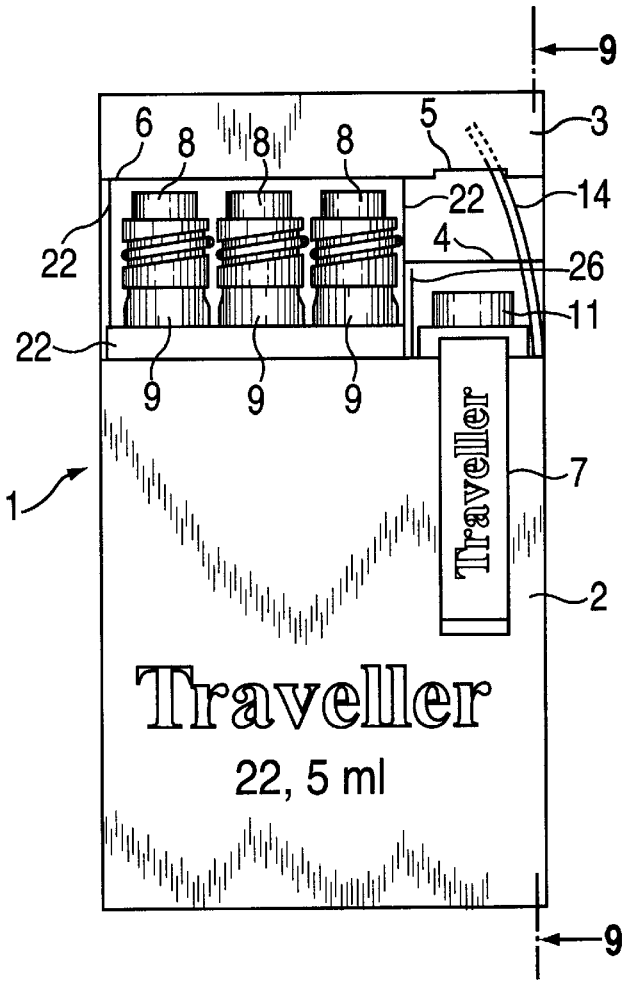
Figure 9:
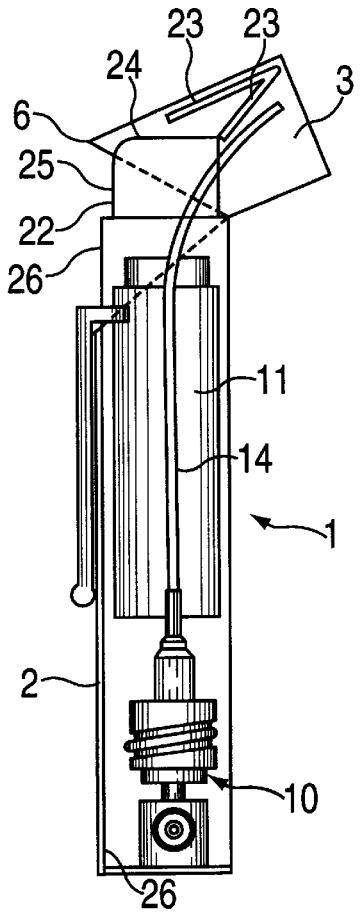
Figure 11:
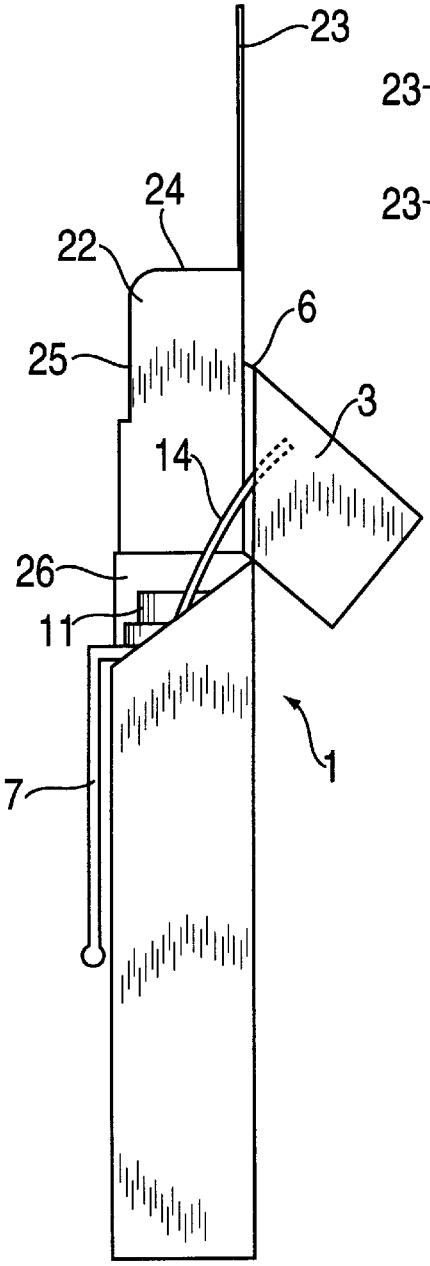
Figure 10:
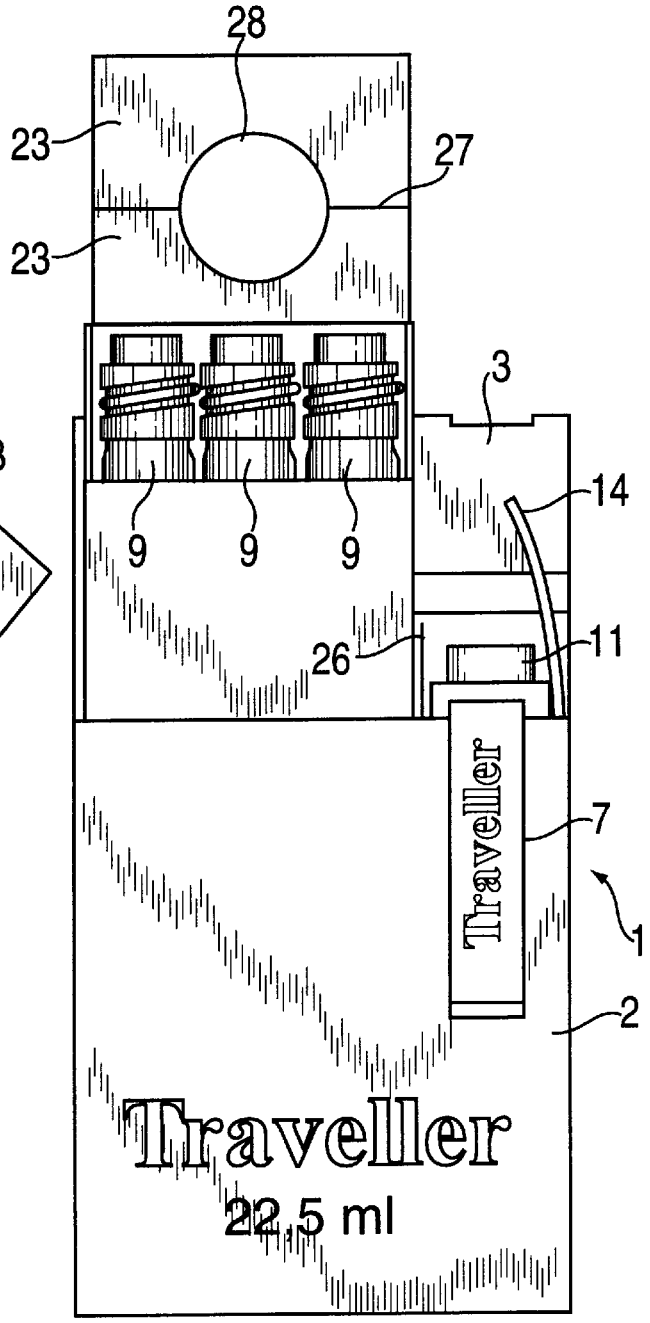
Figure 12:
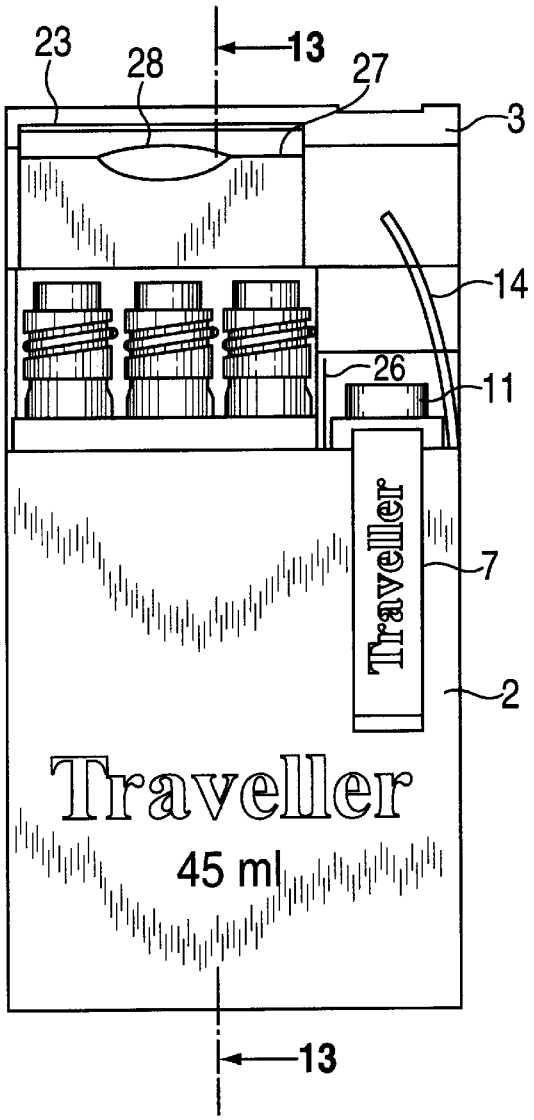
Figure 13:
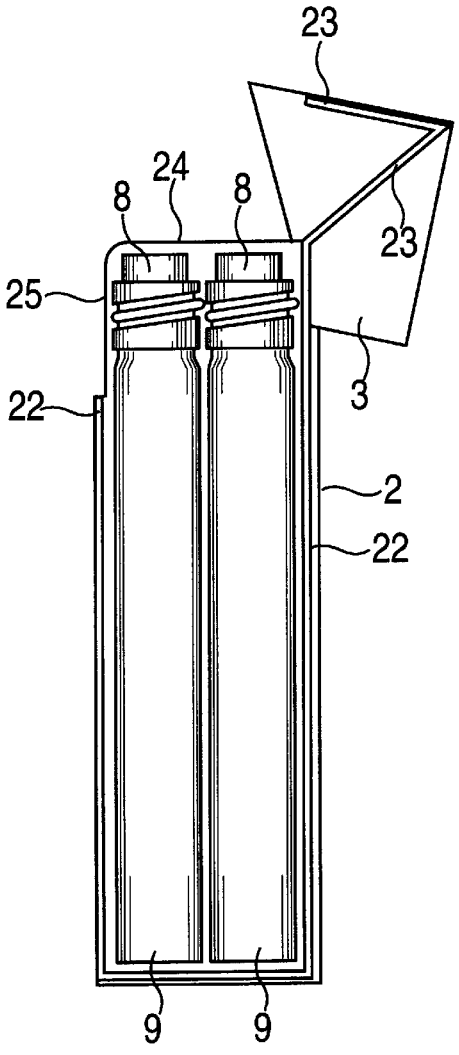
Figure 14:
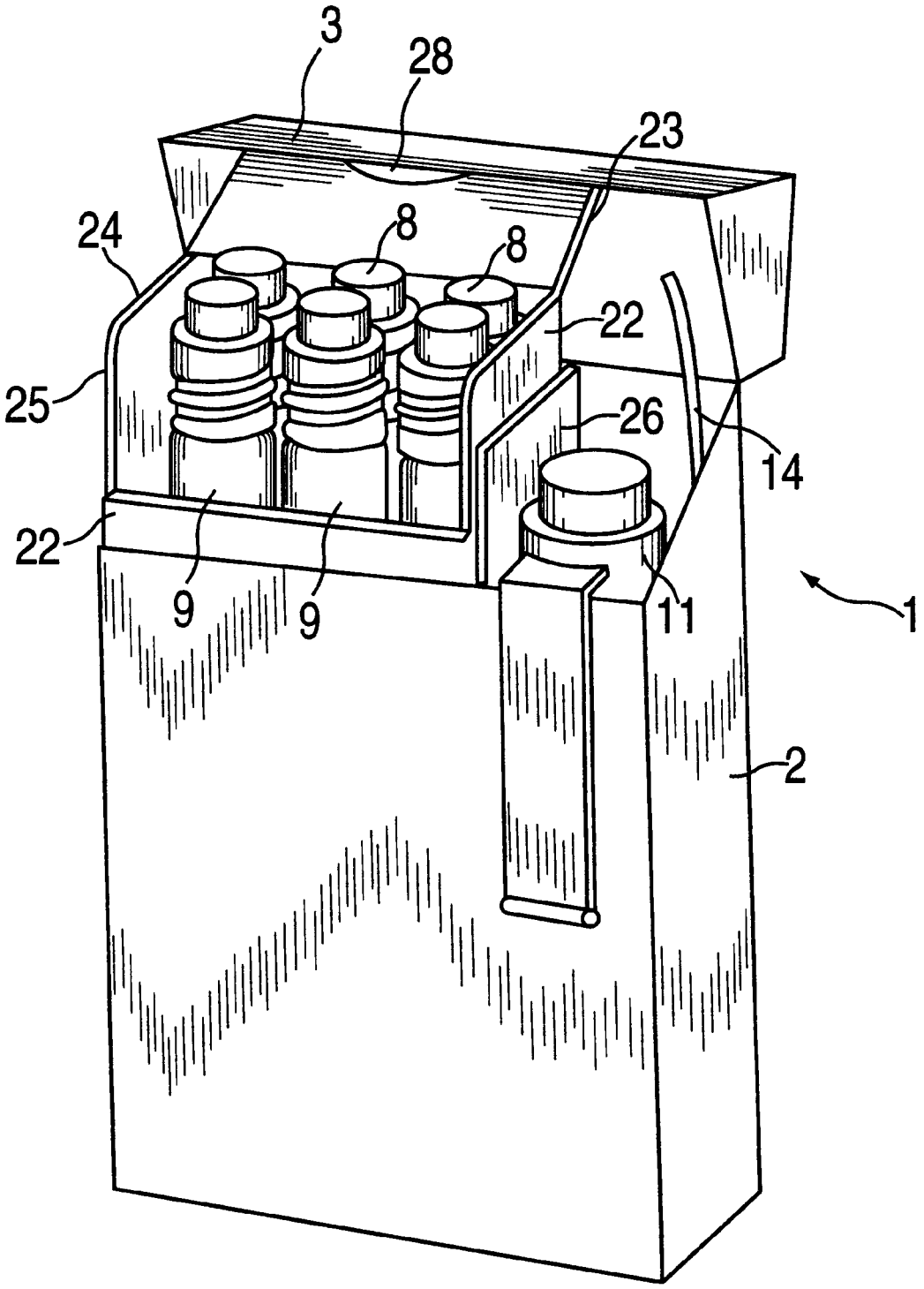

The invention will be explained in more detail hereinafter with reference to the drawing, wherein FIG. 1 shows a packaging unit for rod-shaped perfume bottles having a total capacity of 25 ml, FIG. 2 shows a side view corresponding to FIG. 1, FIG. 3 shows a packaging unit for rod-shaped perfume bottles having a total capacity of 50 ml, FIG. 4 shows a side view corresponding to FIG. 3, FIG. 5 shows a rod-shaped perfume bottle assembled with cap, FIG. 6 shows the perfume bottle according to FIG. 5 separated into its individual parts, with cap turned by 90° compared with FIG. 5, FIG. 7 shows a closure element for the perfume container of a perfume bottle, FIG. 8 shows the packaging unit according to FIG. 1 with partly opened lid, FIG. 9 shows a section in the plane IX—IX according to FIG. 8, FIG. 10 shows the packaging unit according to FIG. 1 with fully opened lid and partly withdrawn sheath for three perfume containers, FIG. 11 shows a side view corresponding to FIG. 10, FIG. 12 shows the packaging unit according to FIG. 3 with partly opened lid, FIG. 13 shows a section in the plane XIII—XIII according to FIG. 12, and FIG. 14 shows a perspective view of the packaging unit according to FIG. 3 with partly opened lid.

FIG. 1 and 2 show a packaging unit for perfume containers which, corresponding to the number thereof, together have a total capacity of 25 ml of perfume, the fictitious brand name "TRAVELLER" being shown on the front side of the case 1 forming the packaging unit to give a sense of reality to the diagram. The case 1 is rectangular and has approximately the form of a standard cigarette case, comprising container part 2 and lid 3. The lid 3 is formed as a folding lid, meaning that, as shown in two different folding positions in FIG. 8 to 11, it can be folded backward around a hinge-like folding edge 4, which simultaneously forms the top edge of the container part 2. The lid 3 is provided on its front side with a flat cut-out 5 in the region of the lower lid edge 6. Through this cut-out 5 there protrudes a clip part 7 of a cap, which is not visible but which can be slipped onto the perfume container located in the case. Such a presentation of the clip part advantageously assists the advertising displayed by the case for the respective perfume bottled in the perfume containers.

FIG. 3 and 4 show a packaging unit for exactly the same perfume containers, the only difference from the case according to FIG. 1 and 2 being the package size. The number of perfume containers accommodated in this unit corresponds to a total capacity of 50 ml of perfume.

The larger packaging unit according to FIG. 3 and 4 differs from the smaller packaging unit according to FIG. 1 and 2 only in its depth, whereas the height and width, which define the front view of the case, are identical.

FIG. 5 to 7 show a completely assembled rod-shaped perfume bottle (FIG. 5), its individual parts (FIG. 6) as well as a closure element 8 (FIG. 7), which seals the actual perfume container 9 instead of the metering pump 10 as long as the perfume container is not assembled as a perfume bottle.

According to FIG. 5, a completely assembled perfume bottle comprises a slender cylindrical perfume container 9, onto which there is slipped a cap 11 with clip part 7. The perfume container 9 is preferably made of tubular glass, but it may also be made of metal or plastic. A threaded section 12 adjoins its opening. A correspondingly formed screw-on sleeve 13 of metering pump 10 can be screwed sealingly onto the threaded section 12. In the completely screwed-on position, the suction tube 14 of the metering pump extends to the bottom 15 of perfume container 9. Above screw-on sleeve 13 of metering pump 10 there is shown the operating button 16 with spray-nozzle hole 17 for operation of the pump mechanism installed inside the housing part 18. Housing part 18 extends downward beyond threaded sleeve 13; there it is provided with a connecting nipple 19 onto which suction tube 14 is slipped.

In FIG. 6 cap 11 is shown turned by 90°, so that clip part 7 appears in front view. The clip part is broad enough that it provides an ideal area to carry an advertisement. At its bottom end, clip part 7 is provided with a standard enlargement 20. Clip part 7 and cap 11 are conveniently made of plastic, the clip part having elastically springy characteristics. The plastic body of cap 11 is preferably provided with an outer skin of metal, for example with gold-colored or silver-colored electroplating. In this embodiment, the perfume bottle as illustrated in FIG. 5 and 6 is widely distributed under the brand name "DUFTPEN".

The closure element 8 illustrated in FIG. 7 comprises a normal threaded cap, if necessary containing a washer on the underside of the cover plate 21. In common with threaded sleeve 13, closure element 8 is also made conveniently of thin sheet, preferably aluminum or plastic.

FIG. 8 and 9 show the case according to FIG. 1 and 2 with half-opened lid 3. It can be seen under lid 3 that case 1 contains three perfume containers 9, each of which is sealed with a closure element 8. The three perfume containers are placed in a box-like sheath 22, for example of thin corrugated paper, which can be closed with a folding cover 23. When lid 3 cf case 1 is folded back, the folding cover 23 is carried along at the inside thereof, as is evident in FIG. 9. If lid 3 of the case is again folded downward into its closed position, folding cover 23 is positioned over the top side edges 24, 25 of the respective side walls of sheath 22. The box-like sheath 22 fits tightly into a compartment of case 1 formed by a partition 26 in the container part 2 thereof. Partition 26 divides the container part into two compartments, namely, according to FIG. 8, a left large compartment for accommodating the box-like sheath 22 containing the perfumes containers 9, and a right small compartment for accommodating the cap 11 plus a metering pump 10, as can be seen without difficulty from the sectional diagram according to FIG. 9. For space reasons, metering pump 10 is disposed underneath cap 11; its suction tube 14 extends past the side of cap 11 to just under lid 3 of case 1.

From the case the user takes one of the three perfume containers 9, removes the closure element 8 and in its place screws the metering pump 10 provided in the small compartment onto the perfume container 9; then she completes the perfume container by slipping on cap 11 to obtain a completely assembled perfume bottle. After the perfume container thereof is empty, it is reinserted into the empty space in box-like sheath 22 and replaced by one of the two still-full perfume containers 9. In this way 25 ml of perfume is available with the packaging unit illustrated in FIG. 8 and 9, assuming each individual perfume container contains exactly 8.25 ml of perfume.

The same is true for the packaging unit illustrated in FIG. 10 and 11. Therein, in contrast to FIG. 8 and 9, the lid 3 of case 1 is completely folded backward. For the purposes of illustration, the box-like sheath 22 containing the three perfume containers 9 is, withdrawn slightly upward, so that lid 3 rests with its bottom edge 6 on the back side of sheath 22. To ensure that folding cover 23 of sheath 22 can be easily opened and closed, it is provided in the region of its folding edge 27 with a circular cut-out 28.

FIG. 12 and 13 show the larger packaging unit according to FIG. 3 and 4, wherein lid 3 of case 1 is partly opened. The box-like sheath for perfume containers 9 contains in this case, as illustrated in FIG. 13, two rows of perfume containers 9, or in total six perfume containers 9. Otherwise the description given hereinabove of the packaging unit containing only three perfume containers according to FIG. 8 and 9 is sufficient to illustrate the packaging unit containing six perfume containers according to FIG. 12 and 13. The same reference numbers are used for like elements.

In the sectional diagram according to FIG. 13, it is particularly obvious how the box-like sheath 22 containing perfume containers 9 is inserted into the inside of case 1 and how folding cover 23 of box-like sheath 22 is trapped with its folding edge 27 in the top front corner of lid 3 of case 1, so that folding cover 23 is opened together with lid 3.

FIG. 14 shows the large packaging unit for 50 ml total capacity assuming 8.25 ml capacity of each of the six perfume containers 9. The six perfume containers are accommodated in the inside of box-like sheath 22, which occupies the large compartment on the left side of partition 26. In the small compartment on the right side of partition 26 of case 1 there is located cap 11 and thereunder metering pump 10, only the bottom end of suction tube 14 of which is visible when it is disposed according to FIG. 10. Since adequate space is available here, however, the pump can also be disposed in inverted orientation, so that the operating button is visible behind cap 11.

I claim:

1. A packaging unit for rod-shaped perfume bottles comprising: a perfume container (9), a metering pump (10) that can be mounted thereon to close the container, and a cap that can be slipped onto the metering pump, wherein in a case (1) comprising container part (2) and lid (3), the container part (2) has at least a first compartment and a second compartment, a bottle is placed in the first compartment, in the second compartment, there is provided a number N of identical perfume container (9), which are closed with a closure element (8), and each perfume container contains a multiple of 25 ml of perfume fluid.

2. A packaging unit per claim 1, wherein the case (1) is of elongated structure and the lid (3) extends transverse to its longitudinal axis.

3. A packaging unit per claim 2, wherein the lid (3) runs transverse to the longitudinal axis of the case and is constructed as a folding lid.

4. A packaging unit per claim 2, wherein the first compartment and the second compartment are aligned in a longitudinal direction, said first compartment is large enough to accommodate individual parts of a perfume bottle and said second compartment is large enough to accommodate a plurality of perfume containers.

5. A packaging unit per claim 4, wherein the perfume containers (9) are located in a separate sheath (22), which can be inserted into the large compartment provided in the case.

6. A packaging unit per claim 5, wherein the sheath (22) for the perfume containers (9) includes a folding cover (23).

7. A packaging unit for rod-shaped perfume bottles, comprising:

a perfume container (9), a metering pump (10) that can be mounted thereon to close the container, a cap that can be slipped onto the metering pump, a case (1) including a container part (2) and lid (3), the container part (2) has at least a first compartment and a second compartment, a bottle is placed in the first compartment, the second compartment includes a plurality, N of identical perfume containers (9), which are closed with a closure element (8), each perfume container contains a multiple of 25 ml of perfume fluid, the case (1) is of elongated structure and the lid (3) extends transverse to its longitudinal axis the first compartment and the second compartment are aligned in a longitudinal direction, said first compartment is large enough to accommodate individual parts of a perfume bottle and said second compartment is large enough to accommodate a plurality of perfume containers, and the perfume containers (9) are located in a separate sheath (22), which can be inserted into the large compartment provided in the case, the sheath (22) for the perfume containers (9) includes a folding cover (23)

the folding cover of the sheath (22) is connected with the inside of the lid (3) of the case (4), wherein upon opening of the lid (3) of the case (1), the cover of the sheath (22) is also opened.

8. A packaging unit for rod-shaped perfume bottles comprising:

a perfume container (9), a metering pump (10) that can be mounted thereon to close the container, a cap that can be slipped onto the metering pump, said packaging unit comprises:

a case (1) including(2 a container part (2) and lid (3), the container part (2) has at least a first compartment and a second compartment, a bottle is placed in the first compartment, the second compartment includes a plurality, N of identical perfume containers (9), which are closed with a closure element (8), and each cylindrical perfume container contains a multiple of 25 ml of perfume fluid, the case (1) is of elongated structure and the lid (3) extends transverse to its longitudinal axis wherein between lid (3) and container part (2), the case (1) is provided with a cut-out (5), through which a clip part (7) connected to the cap (11) of the completely assembled bottle can protrude, so that it is secured clampingly against the outside of the case (1).

9. A packaging unit for rod-shaped perfume bottles comprising:

a perfume container (9), a metering pump (10) that can be mounted thereon to close the container, a cap that can be slipped onto the metering pump, a case (1) includes a container part (2) and lid (3), the container part (2) has at least a first compartment and a second compartment, a bottle is placed in the first compartment, the second compartment includes a plurality, N of identical perfume containers (9), which are closed with a closure element (8), and each cylindrical perfume container contains at least a multiple of 25 ml of perfume fluid, wherein six perfume containers (9) are disposed in two rows one behind the other in the second compartment, and one loose metering pump (10) and one cap (11) for completely assembling a bottle with a perfume container (9) from the large compartment are disposed in the first compartment.

10. A packaging unit for rod-shaping perfume bottles comprising:

a perfume container (9), a metering pump (10) that can be mounted thereon to close the container, a cap that can be slipped onto the metering pump, a case (1) including a container part (2) and lid (3), the container part (2) has at least a first compartment and a second compartment, a bottle is placed in the first compartment, the second compartment includes a plurality, N of identical perfume containers (9), which are closed with a closure element (8) and each cylindrical perfume container contains a multiple of 25 ml of perfume fluid, the case (1) is of elongated structure and the lid (3) extends transverse to its longitudinal axis, wherein three perfume containers (9) are disposed side by side in the second compartment, and in that one cap (11) and one loose metering pump (10) for completely assembling a bottle with a perfume container (9) from the large compartment are disposed in the first compartment.

11. A packaging unit for rod-shaped perfume bottles according to claim 1 wherein the bottle is in assembled form.

12. A packaging unit for rod-shaped perfume bottles according to claim 1, wherein the bottle is in the form of individual parts.

13. A packaging unit for rod-shaped perfume bottles according to claim 1, wherein the cap includes a clip part.

14. A packaging unit for rod-shaped perfume bottles according to claim 1, wherein the perfume container is cylindrical.

* * * * *